United States Patent [19]

Cartier

[11] 3,977,396

[45] Aug. 31, 1976

[54] APPARATUS FOR TREATING VASCULAR OEDEMATA

[76] Inventor: Claude Julien Cartier, 11, rue Bourdillon, Chateauroux (Indre), France

[22] Filed: Apr. 11, 1975

[21] Appl. No.: 567,132

[30] Foreign Application Priority Data

Apr. 17, 1974 France ..... 74.13279

[52] U.S. Cl. ..... 128/65

[51] Int. Cl.[2] ..... A61H 9/00

[58] Field of Search ..... 128/24 R, 38–40, 128/60, 297–299, 64–66

[56] References Cited

UNITED STATES PATENTS

| | | | |
|---|---|---|---|
| 3,094,983 | 6/1963 | MacLeod | 128/65 X |
| 3,234,935 | 2/1966 | Bell et al. | 128/66 |
| 3,286,711 | 11/1966 | MacLeod | 128/40 |

*Primary Examiner*—Lawrence W. Trapp
*Attorney, Agent, or Firm*—Murray Schaffer

[57] ABSTRACT

Apparatus for the treating of oedemata by which the bad limb is immersed vertically in a tub of mercury. An impermeable flexible sleeve is sealed to the edge of the tub. Fluid under pressure is admitted at the top of the tub into the space between the tub and the sleeve so that its pressure may add itself to the static pressure of the mercury, which increases from top to bottom.

15 Claims, 2 Drawing Figures

APPARATUS FOR TREATING VASCULAR OEDEMATA

Vascular oedemata of the upper and lower limbs have been found to respond to a form of therapy which consists in reducing the oedemata mechanically by the application of external pressure. Accordingly, the stasis liquid must have imparted to it a direction of flow such as to gradually convey it up to the root of the limb, and, since a flux is possible only between a high-pressure segment and a lower-pressure segment, the limb must be subjected to pressure which increases uniformly towards the end of the limb, the pressure being exerted at all times perpendicularly to the surface of the skin.

It is accordingly proposed to immerse the limb vertically in a liquid, and to use mercury as a liquid of highest density thereby to produce a significant pressure gradient. Further, in order to ensure that the absolute pressure achievable will suffice in all cases, a gas pressure adjustable as desired is caused thereafter to prevail at the surface of the mercury bath. The limb to be treated is surrounded by a fluidtight sleeve before it is set under compression.

In accordance with this invention, the limb is firstly placed vertically in its fluidtight sleeve, the mercury level is then made to rise, and the surface of the mercury is thereafter set under adjustable gas pressure. The apparatus accordingly includes a generally cylindrical tub having the protective sleeve for receiving the limb to be treated fluidtightly secured to its upper edge. The mercury (supplied from a communicating vessel) is admitted from the bottom into the space between the outer surface of the sleeve and the side wall of the tub, and a pressurized gas (such as nitrogen supplied from a bottle of compressed gas) is then admitted through the top after closure of the mercury inlet valve and exerts pressure against the surface of the mercury.

The description which follows with reference to the accompanying non-limitative exemplary drawing will give a clear understanding of how the invention can be carried into practice.

Figure 1:
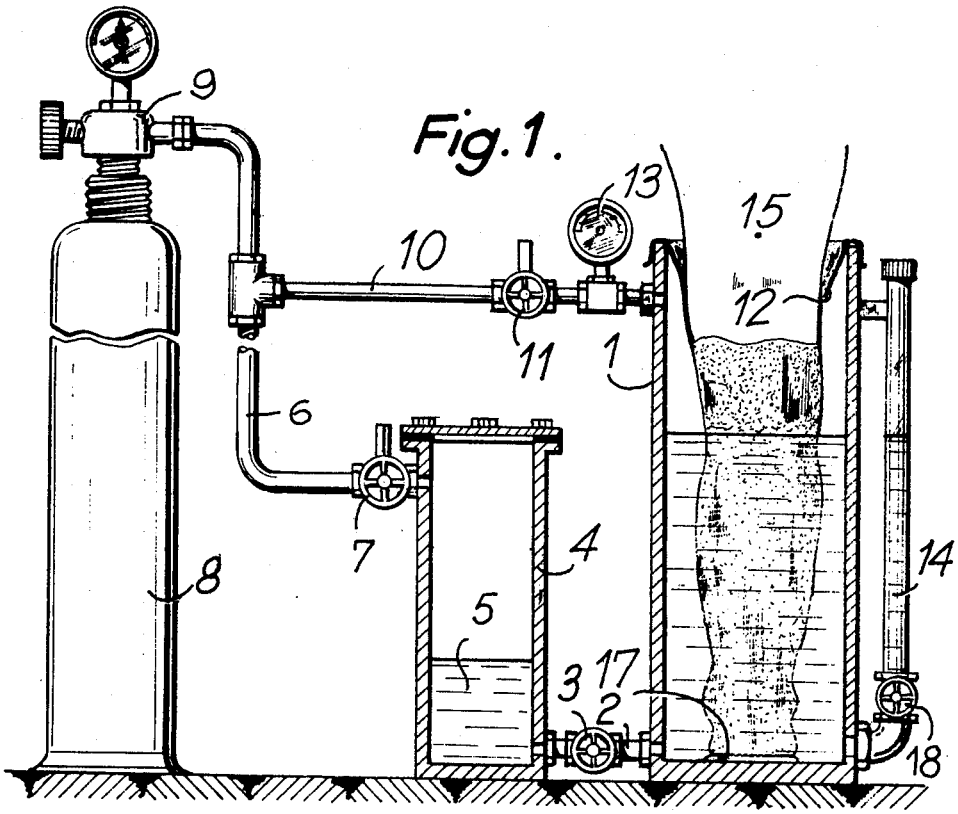
FIG. 1 shows in vertical section apparatus for treating a bad leg.

The illustrated apparatus includes a cylindrical tub 1 the bottom of which communicates, through a pipe 2 having a valve 3 thereon, with a tank like vessel 4 containing mercury 5. The top of vessel 4 communicates, through a pipe 6 having a valve 7 thereon, with a source of compressed gas such as a bottle of nitrogen 8 fitted in the usual way with a pressure-reducing valve 9. Through a conduit 10 having a valve 11 thereon, pressure-reducing valve 9 likewise communicates with the space between tub 1 and a flexible impermeable sleeve 12 capable of receiving a right or a left hand limb, which is fluidtightly sealed to the upper edge of tub 1 and which is so devised as to be able to receive either a right or left limb. A pressure-gauge 13 continuously monitors the gas pressure in the space between tub 1 and sleeve 12. A transparent tube 14 having a valve 18 connected thereinto further allows checking the mercury level in the tub 1.

For therapeutic treatment, the limb 15 is inserted into sleeve 12. The valve 7 is then opened to exert a desired gas pressure against the mercury 5 in the vessel 4, whereby if the valve 3 is then opened the mercury will rise to a certain level within the tub 1. Having thereafter closed valve 3, valve 11 is opened in order to admit nitrogen in small quantities under pressure into the sealed space above the mercury in tub 1, between the latter and sleeve 12, until the pressure-gauge 13 indicates the required pressure.

The limb 15 is thus subjected to a pressure which gradually varies from $p$ to $(P + p)$, as one moves towards the end of the limb, where $p$ is the gas pressure and P the hydrostatic pressure exerted by the column of mercury in the lower part of tub 1.

In order to enable the patient to withstand the hydrostatic pressure of the mercury without excessive fatigue, provision is made for securing the lower end of protective sleeve 12 to the bottom of tub 1. When a leg is being treated, the lower end of sleeve 12 is equipped with a sole 17 made fast with the bottom of tub 1.

Figure 2:
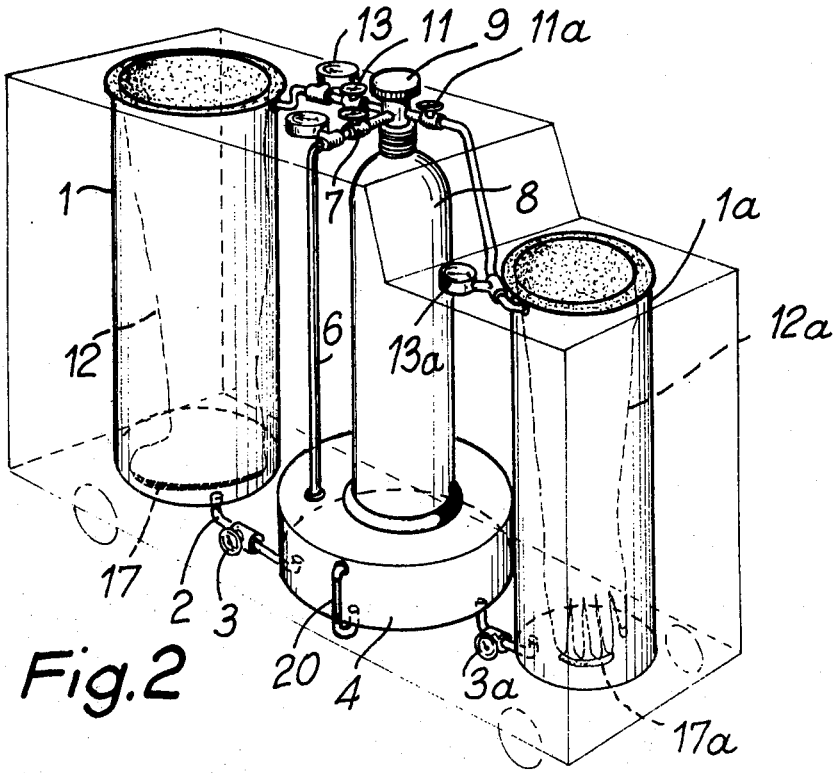
FIG. 2 shows in perspective a form of embodiment for treating an arm or a leg.

In FIG. 2 a common housing 19 depicted in part by dash lines, contains a tub 1 similar to the tub in FIG. 1 for leg treatment, and a somewhat shallower tub 1*a* of smaller diameter for arm treatment. Through the agency of interposed valves 3 and 3*a*, these tubs communicate with a common leaktight mercury tank 4 of flat shape having a transparent mercury level indicator 20.

The tank 4 supports the pressurized-gas bottle 8 which communicates through suitable pipes 10, 10*a* and 6 with tubs 1 and 1*a* and with tank 4.

It goes without saying that changes and substitutions may be made to the forms of embodiment hereinbefore described without departing from the scope of the invention. In particular, the bottle 8 and the pipes leading therefrom may be replaced by ordinary hand-operated rubber bulbs for the purpose of conveying air under pressure both to the top of vessel 4 and to the top of tub 1. Furthermore, the fluidtight vessel 4 may be replaced by a container which is movable vertically, along a rack for example, in order to supply the tub 1 by the principle of communicating vessels. Moreover, the overpressure exerted at the surface of the mercury may be provided by a vertical mercury column communicating with the upper part of tub 1, which would have a cross-section of $1 cm^2$ and a height of 60cm to 80cm and which would be filled with mercury to a lesser or greater extent depending on the pressure to be exerted on the limb.

What I claim is:

1. Apparatus for treating vascular oedemata of limbs comprising a tub adapted for the vertical immersion of the bad limb in a quantity of mercury having a high static pressure gradient provided within said tub, and means for applying a gaseous fluid under pressure to the surface of the mercury to selectively increase the pressures prevailing within the mercury at different levels thereof, as a function of the clinical characteristics of the oedema to be treated.

2. The apparatus according to claim 1, including an impermeable flexible sleeve through which the bad limb is inserted and which has its upper end sealed fluid-tightly to the upper rim of the tub, thereby to bound at the surface of the mercury a sealed space into which the fluid under pressure may be admitted.

3. The apparatus according to claim 2, wherein the sleeve has its lower end fixed to the bottom of the tub.

4. The apparatus according to claim 2, wherein the sleeve is shaped to permit insertion of either a right or left limb without distinction.

5. The apparatus according to claim 4, wherein said sleeve is formed to receive one of said upper or lower limbs.

6. The apparatus according to claim 1 including a source of mercury and means for feeding said mercury selectively through the bottom of the tub.

7. The apparatus according to claim 6 including means for indicating the mercury level in the tub.

8. The apparatus according to claim 1 including a source of compressed gas, a gas conduit connecting said source to the top of said tub and a pressure gauge located in said conduit for indicating the gas pressure exerted on said mercury.

9. The apparatus according to claim 6 wherein said source of mercury is contained in a tank and the means for feeding said mercury to said tub comprises a source of compressed gas selectively applied to said tank, and means for indicating the pressure of said mercury in said tank, said pressure prevailing in the mercury being equal to the sum of the column of mercury in said tub and the gas pressure required to drive the mercury from said tank to said tub.

10. The apparatus according to claim 9, wherein the source of the compressed gas for driving the mercury from its tank into the tub and for exerting the overpressure at the surface of the mercury in said tub is the same.

11. The apparatus according to claim 1, characterized by the fact that the gas is nitrogen.

12. The apparatus according to claim 1, including a housing, an arm treatment tub and a leg treatment tub located within said housing, a common source of compressed gas located in said housing and appropriate conduit and valve means for controlling the flow of gas.

13. A method for the treatment of vascular oedema comprising the steps of vertically immersing the bad limb in a tub of mercury and simultaneously applying a gaseous fluid to the surface of said mercury to increase the pressure of said mercury on the limb at different levels thereof in a gradient resulting from the complementary use of the static pressure provided by the column of mercury and the fluid pressure on its surface.

14. The method according to claim 13 including the step of varying the height of the column of mercury and the pressure of the applied fluid as a function of the clinical characteristics of the oedema being treated.

15. The method according to claim 13 including the step of enclosing said limb in an impermiable sheath prior to immersion in said mercury.

* * * * *